United States Patent [19]

Faiella

[11] 4,266,553

[45] May 12, 1981

[54] FOOTGEAR EMBODYING PODIATRIC SOLE

[76] Inventor: Joseph V. Faiella, 9 Northern Blvd., Greenvale, N.Y. 11548

[21] Appl. No.: 87,253

[22] Filed: Oct. 22, 1979

[51] Int. Cl.[3] ..... A61F 5/14

[52] U.S. Cl. ..... 128/585

[58] Field of Search ..... 128/585, 584, 583, 80 R

[56] References Cited

U.S. PATENT DOCUMENTS

| | | | |
|---|---|---|---|
| 1,958,097 | 5/1934 | Shaw | 128/585 |
| 2,193,704 | 3/1940 | Vaughn | 128/585 X |
| 2,345,820 | 4/1944 | Kohn | 128/585 |
| 2,390,416 | 12/1945 | Bettmann | 128/585 |
| 2,616,190 | 11/1952 | Darby | 128/585 |

FOREIGN PATENT DOCUMENTS

| | | | |
|---|---|---|---|
| 968858 | 3/1958 | Fed. Rep. of Germany | 128/585 |

*Primary Examiner*—John D. Yasko

*Attorney, Agent, or Firm*—Charles P. Bauer

[57] ABSTRACT

A sole, which has been made an integral part of a normal last footgear or to which uppers have been added to form a shoe, which sole inverts or turns in the rearfoot and/or forefoot to eliminate abnormal motion and maintain the foot in a near normal position.

1 Claim, 8 Drawing Figures

10
11
10

10
7
TOE BOX
12
3
3
METATARSUS
4
15
4
ARCH
SUPPORT
14
5
5
6
6
HEEL
CUP 13
7

12

4°
15

14

4°
16
13

12
15
14
13

12
13
17

FOOTGEAR EMBODYING PODIATRIC SOLE

BACKGROUND OF THE INVENTION

1. Field of the Invention

This invention relates to soles for various footgear and more particularly to a sole which is wedged in the forefoot and/or in the rearfoot to eliminate abnormal eversion or turning out of the forefoot and/or rearfoot.

2. Brief Description of the Prior Art

The use of orthopedic appliances, which are inserted into or added to normal last footgear to correct abnormal eversion or turning out of the forefoot and/or rearfoot, is well known. However, such appliances have certain disadvantages because they shift in the footgear with walking and do not provide the accurate positioning necessary to correct the foot defect properly. The sole of the present invention which is built in as an integral part of the footgear overcomes these disadvantages and gives the correction more accurately than is possible with orthopedic appliances.

SUMMARY OF THE INVENTION

The invention comprises a sole forming an integral part of the last footgear and extending from heel to toe through the metatarsus, which sole comprises a forefoot wedge behind the metatarsus heads varying between 0.5° and 6°; and a rearfoot wedge at the heel area which can vary between 0.5° and 6°;

whereby the sole inverts or turns in the rearfoot and forefoot by 0.5° to 6° and eliminates abnormal motion and maintains the foot in a near normal position.

Such sole may also comprise a hollow heel cup and an arch support. The footgear with such sole may also provide a wider and higher toe box.

Figures 1, 2, 3, 4, 5, 6, 7, 7A:
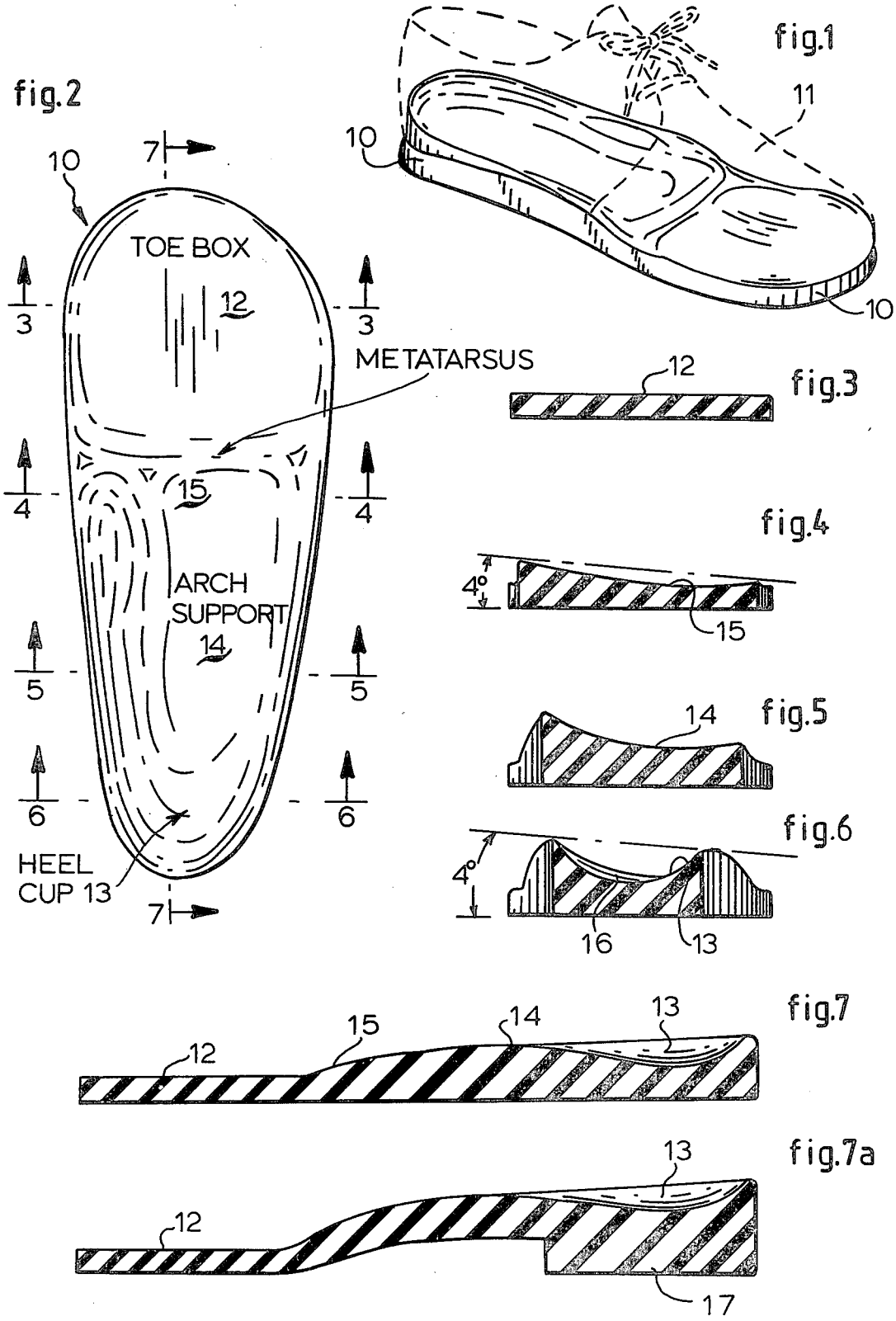
FIG. 1 is a perspective view of a shoe embodying the sole of the present invention.
FIG. 2 is a top plan view of the sole shown in FIG. 1.
FIG. 3 is a sectional view along the line 3—3 of FIG. 2.
FIG. 4 is a sectional view along the line 4—4 of FIG. 2.
FIG. 5 is a sectional view along the line 5—5 of FIG. 2.
FIG. 6 is a sectional view along the line 6—6 of FIG. 2.
FIG. 7 is a sectional view along the line 7—7 of FIG. 2.

FIG. *7a* is a view showing a modification of the sole of FIG. 7 with a heel added.

DETAILED DESCRIPTION OF THE PREFERRED EMBODIMENTS OF THE INVENTION

It has been found that most foot pathologies are caused by abnormal eversion or turning out of the forefoot and/or rearfoot. These manifest themselves in corns; calluses, hammer toes; bunions (Hallux Valgus); chronic ankle sprains; flat feet (Pes Valgo Planus or Pes Planus); bursitis (Metatarsal, Inferior or Posterior Calcaneal, Hallux); Mortons Toe or intermetatarsal neuritis; sesamoiditis; forefoot or rearfoot varus; calcaneal pronation; plantar flexed flexible first metatarsal; chronic low back pain, leg or thigh fatigue, sciatica, knee or hip pain secondary to foot pathology; plantar fascitis; arch fatigue or pain; Haglunds Deformity.

The sole of the present invention inverts or turns in the rearfoot and/or forefoot by a certain number of degrees as determined by a podiatrist or a physician familiar with orthopedics.

Referring to the drawings there is shown in FIG. 1 the sole 10 of the present invention to which has been added uppers 11 to form a complete shoe.

Depending on the type of footgear, the material for the sole can be leather, wood, plastic, metal, cork, hard or soft rubber, or any combination of such materials and can be rigid or flexible.

The sole illustrated in FIGS. 2 and 7 can be divided into the following general areas so labeled on FIG. 2: toe box, metatarsus, arch and heel. The wedging or corrective portions, illustrated in FIGS. 3, 4, 5 and 6, are aligned on the sheet of drawings with the sole of FIGS. 2 and 7 to show where such portions are provided in the sole. These portions may be described as follows:

A. A wider and higher toe box 12 (FIGS. 2 and 3).

B. A hollow heel cup 13 (FIGS. 2 and 6).

C. An arch support 14 (FIGS. 2 and 5).

D. An inner or medial forefoot wedge 15 across the sole behind the metatarsus, the angle of which wedge can vary between 0.5° and 6° (FIGS. 2 and 4). FIG. 4 illustrates a 4° wedge.

E. An inner or medial rearfoot wedge 16 across the sole at the heel area, the angle of which wedge can vary between 0.5° and 6° (FIGS. 2 and 6). FIG. 6 illustrates a 4° wedge.

The degree of wedging in the forefoot and rearfoot is determined by the patient's podiatrist or family physician familiar with orthopedics. If necessary such wedging can be increased or decreased either by adding further wedging to either medial or lateral aspect of the heel area and/or sole area or by inserting a removable inner sole and wedging it accordingly.

FIGS. 7 and *7a* illustrate variations of the sole depending on whether or not the footgear will embody a heel. FIG. 7 shows the bottom of the sole in a single plane from toe to heel whereas FIG. *7a* shows a sole which is in a single plane fo the toe area, angles upward through the metatarsus and arch areas, and then flattens out for the heel area to provide for the elevation caused by the heel 17.

Although the incorporation of the wedging or corrective portions directly into the sole of footwear as an integral part thereof may appear to be a simple solution to certain foot problems, there are distinct and unexpected advantages of the present invention over the insertion or addition of such portions to existing footwear, as follows:

1. They eliminate casting.
2. The eliminate laboratory fabrication.
3. They eliminate laboratory fees.
4. They eliminate the need for larger size shoes.
5. They can be incorporated into more fashionable shoes, such as high heel open back women's shoes, sandals and slippers.
6. The wedgings are on the interior aspect of the sole, in direct contact with the foot, thus allowing for better control and function, whereas prior wedges were on the exterior portion of the sole, were visible and not as functional.

Those skilled in the art will appreciate that many variations of the above described embodiment of the invention may be made without departing from the spirit and scope of the invention.

What is claimed is:

1. Footgear embodying a podiatric sole forming an integral part of the inside of the footgear and extending from the heel to the toe through the metatarsus, the said sole comprising:

a forefoot wedge across the sole behind the metatarsus heads, which wedge may vary between 0.5° and 6° with respect to the plane across the bottom of the footgear in the toe area;

whereby the wedge inverts the forefoot the required number of degrees to eliminate abnormal motion and maintain the foot in a near normal position.

* * * * *